US008038281B2

(12) United States Patent
Kwong et al.

(10) Patent No.: US 8,038,281 B2
(45) Date of Patent: Oct. 18, 2011

(54) MEDIA PREHEATER

(75) Inventors: Kelvin Kwong, Tualatin, OR (US); Darrell Ray Finneman, Albany, OR (US); Stephen Ray Ricketts, Wilsonville, OR (US); Samuel John Geser, Tigard, OR (US)

(73) Assignee: Xerox Corporation, Norwalk, CT (US)

( * ) Notice: Subject to any disclaimer, the term of this patent is extended or adjusted under 35 U.S.C. 154(b) by 1098 days.

(21) Appl. No.: 11/655,530

(22) Filed: Jan. 19, 2007

(65) Prior Publication Data

US 2008/0174647 A1 Jul. 24, 2008

(51) Int. Cl.
*B41J 2/01* (2006.01)

(52) U.S. Cl. ..... 347/102; 347/103

(58) Field of Classification Search ..... 347/102, 347/103; 219/216
See application file for complete search history.

(56) References Cited

U.S. PATENT DOCUMENTS

| | | | | |
|---|---|---|---|---|
| 4,272,673 | A * | 6/1981 | Semanaz et al. | 219/544 |
| 5,860,052 | A * | 1/1999 | Ohtsuka et al. | 399/329 |
| 5,930,459 | A * | 7/1999 | Eckman et al. | 392/503 |
| 6,337,470 | B1 * | 1/2002 | Von Arx et al. | 219/544 |
| 6,415,104 | B1 * | 7/2002 | Fitts et al. | 392/503 |
| 7,102,102 | B2 | 9/2006 | Godil et al. | |

* cited by examiner

*Primary Examiner* — Matthew Luu
*Assistant Examiner* — Rut Patel
(74) *Attorney, Agent, or Firm* — Maginot, Moore & Beck LLP

(57) ABSTRACT

A heater for preheating media in an imaging device including a substantially planar polymeric carrier having an exterior surface. A channel is recessed into the exterior surface of the carrier. A resistance heating element is disposed in the channel, the resistance heating element having a first and second end for coupling to a power source. The heater includes an over molded polymeric layer disposed in the channel such that the resistance heating element is substantially encapsulated in the channel and such that an exterior surface of the over molded layer is substantially flush with the exterior surface of the carrier.

18 Claims, 7 Drawing Sheets

MEDIA PREHEATER

TECHNICAL FIELD

This disclosure relates generally to ink jet printers that generate images on media sheets, and, more particularly, to the components for heating media sheets before transferring the images to media sheets in such printers.

BACKGROUND

Ink jet printing systems using an intermediate imaging member are well known, such as that described in U.S. Pat. No. 5,614,922. Generally, the printing or imaging member is employed in combination with a print head to generate an image with ink. The ink is typically applied or emitted onto a final receiving surface or print medium by the nozzles of the print head. The image is then transferred and fixed to a final receiving surface. In two stage offset printing, the image is first transferred to the final receiving surface and then transfixed to the surface at a separate station. In other ink jet printing systems, the print head ejects ink directly onto a receiving surface and then the image is fixed to that surface.

More specifically, a solid ink jet or phase-change ink imaging process includes loading a solid ink stick or pellet into a feed channel. The ink stick or pellet is transported down the feed channel to a melt plate where the solid ink is melted. The melted ink drips into a heated reservoir where it is maintained in a liquid state. This highly engineered ink is formulated to meet a number of constraints, including low viscosity at jetting temperatures, specific visco-elastic properties at component-to-media transfer temperatures, and high durability at room temperatures. Once within the print head, the liquid ink flows through manifolds to be ejected from microscopic orifices through use of piezoelectric transducer (PZT) print head technology. The duration and amplitude of the electrical pulse applied to the PZT is very accurately controlled so that a repeatable and precise pressure pulse may be applied to the ink, resulting in the proper volume, velocity and trajectory of the droplet. Several rows of jets, for example, four rows, can be used, each one with a different color. The individual droplets of ink are jetted onto a thin liquid layer, such as silicone oil, for example, on the imaging member. The imaging member and liquid layer are held at a specified temperature such that the ink hardens to a ductile visco-elastic state.

After the ink is deposited onto the imaging member to form the image, a sheet of print medium is removed from a media supply and fed to a preheater in the sheet feed path. After the sheet is heated, it moves into a nip formed between the imaging member and a transfer member, either or both of which can also be heated. A high durometer transfer member is placed against the imaging member in order to develop a high-pressure nip. As the imaging member rotates, the heated print medium is pulled through the nip and pressed against the deposited ink image, thereby transferring the ink to the print medium. The transfer member compresses the print medium and ink together, spreads the ink droplets, and fuses the ink droplets to the print medium. Heat from the preheated print medium heats the ink in the nip, making the ink sufficiently soft and tacky to adhere to the print medium. When the print medium leaves the nip, stripper fingers or other like members, peel it from the imaging member and direct it into a media exit path.

To optimize image resolution, the transferred ink drops should spread out to cover a predetermined area, but not so much that image resolution is compromised or lost. Additionally, the ink drops should not melt during the transfer process.

To optimize printed image durability, the ink drops should be pressed into the paper with sufficient pressure to prevent their inadvertent removal by abrasion. Finally, image transfer conditions should be such that nearly all the ink drops are transferred from the imaging member to the print medium. Therefore, efficient transfer of the image from the imaging member to the media is highly desirable.

Efficient transfer of ink or toner from an intermediate imaging member to a media sheet is enhanced by heating a media sheet before it is fed into the nip for transfer of the image. Preconditioning of the recording medium typically prepares the recording medium for receiving ink by driving out excess moisture that can be present in a recording medium, such as paper. Not only does this preconditioning step reduce the amount of time necessary to dry the ink once deposited on the recording medium, but this step also improves image quality by reducing paper cockle and curl, which can result from too much moisture remaining in the recording medium.

Prior art preheaters typically comprised a laminar assembly in which a heating element is adhered to a thermally conductive material, typically Kapton, using a layer of adhesive. Laminating techniques, however, may leave air gaps between the layers making uniform heating difficult. Additionally, insufficient bonding between the layers can cause delamination. Entrapped air and insufficient bonding may lead to stress cracks that can limit the heating element's ability to generate heat homogeneously, which tends to create hot and cold spots along the length of the element.

SUMMARY

A heater for preheating media in an imaging device comprises a substantially planar polymeric carrier having an exterior surface. A channel is recessed into the exterior surface of the carrier. A resistance heating element is disposed in the channel, the resistance heating element having a first and second end for coupling to a power source. The heater includes an over molded polymeric layer disposed in the channel such that the resistance heating element is substantially encapsulated in the channel and such that an exterior surface of the over molded layer is substantially flush with the exterior surface of the carrier.

In another embodiment, a method of manufacturing a heating element for preheating media in an imaging device comprises providing a polymer carrier assembly having a channel formed therein. A resistance heating wire is then placed in the channel. The channel is then over molded with a polymer layer thereby encapsulating the resistance heating wire in the channel.

In yet another embodiment, a heating element for preheating media in an imaging device comprises a substantially polymeric planar carrier assembly including an exterior surface, a leading edge and a trailing edge. The carrier assembly also includes a pair of electrical contacts formed in the exterior surface of the carrier assembly for connecting to a power source. A channel is formed in the exterior surface of the carrier assembly. The channel defines a circuitous path across a length and width of the carrier assembly. A resistance heating element is disposed in the channel. The resistance heating element has a first and second termination electrically coupled to the pair of electrical contacts. An over molded polymeric layer is disposed in the channel substantially encapsulating the resistance heating element in the channel.

An upper surface of the over molded layer is substantially flush with the exterior surface of the carrier assembly.

BRIEF DESCRIPTION OF THE DRAWINGS

The foregoing aspects and other features are explained in the following description, taken in connection with the accompanying drawings, wherein.

DETAILED DESCRIPTION

Figure 1:
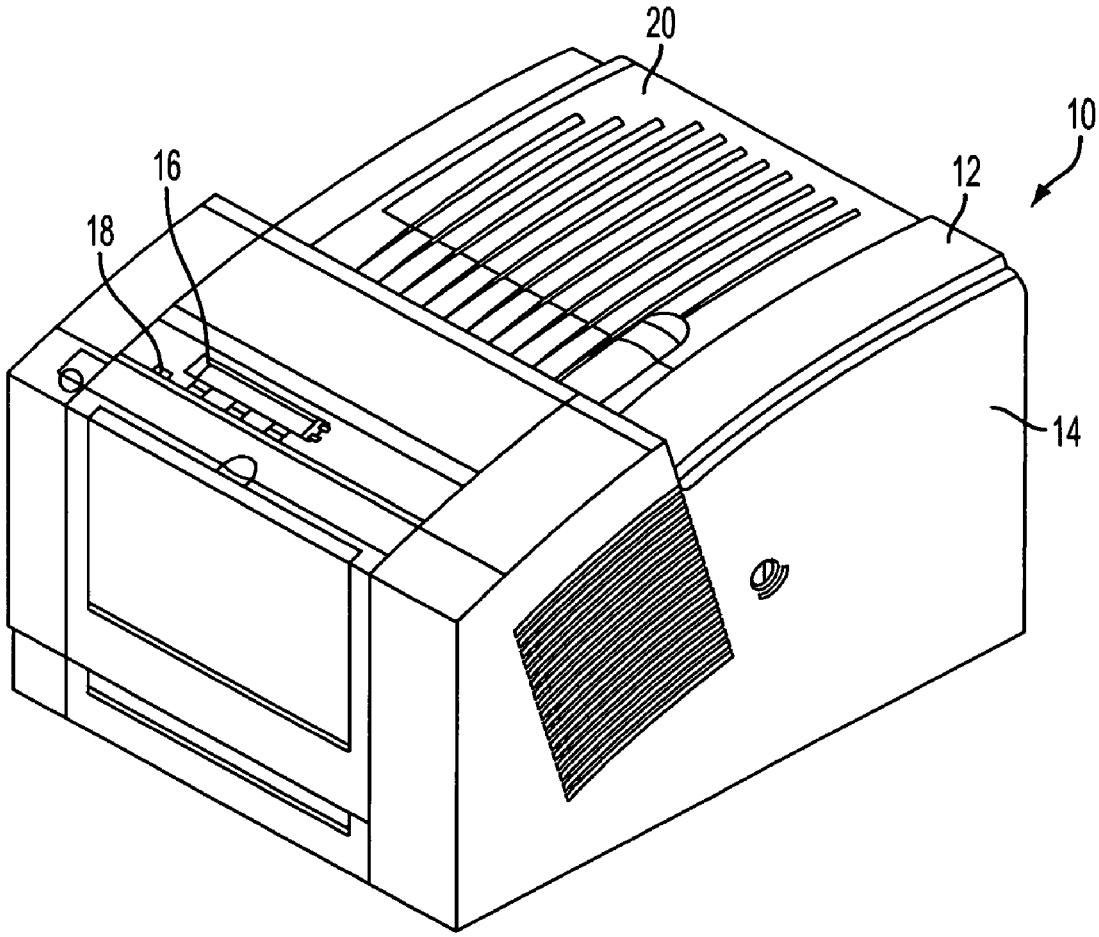
FIG. 1 is a perspective view of a phase change imaging device having a media preheater in accordance with the present disclosure.

For a general understanding of the present embodiments, reference is made to the drawings. In the drawings, like reference numerals have been used throughout to designate like elements.

Referring to FIG. 1, there is shown a perspective view of an ink printer 10 that implements a solid ink offset print process. The reader should understand that the embodiment discussed herein may be implemented in many alternate forms and variations and is not limited to solid ink printers only. The system and process described below may be used in image generating devices that operate components at different temperatures and positions to conserve the consumption of energy by the image generating device. Additionally, the principles embodied in the exemplary system and method described herein may be used in devices that generate images directly onto media sheets. In addition, any suitable size, shape or type of elements or materials may be used.

FIG. 1 shows an ink printer 10 that includes an outer housing having a top surface 12 and side surfaces 14. A user interface display, such as a front panel display screen 16, displays information concerning the status of the printer, and user instructions. Buttons 18 or other control elements for controlling operation of the printer are adjacent the user interface window, or may be at other locations on the printer. An ink jet printing mechanism (not shown) is contained inside the housing. An ink feed system delivers ink to the printing mechanism. The ink feed system is contained under the top surface of the printer housing. The top surface of the housing includes a hinged ink access cover 20 that opens as shown in FIG. 2, to provide the user access to the ink feed system.

Figure 2:
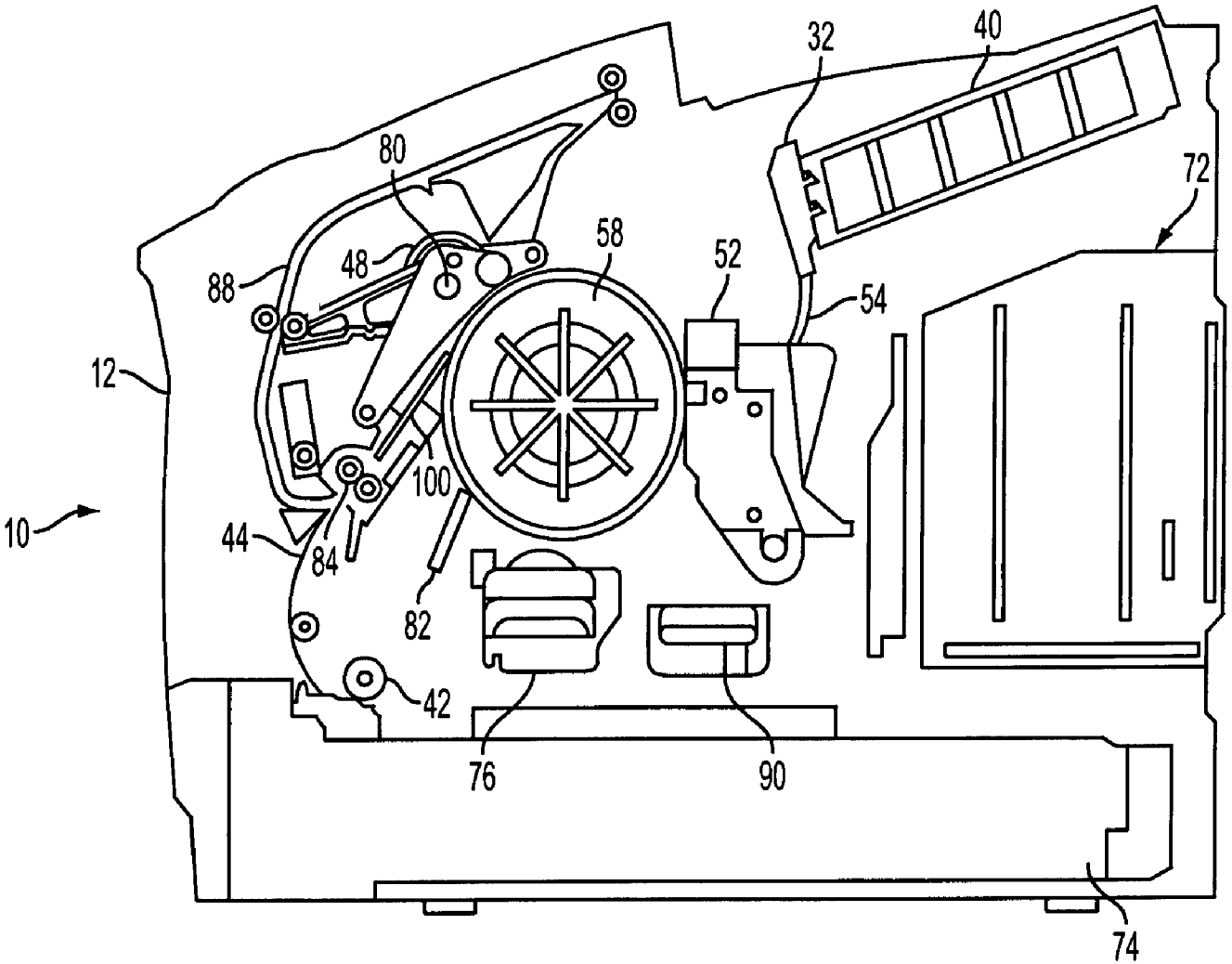
FIG. 2 is a side view of the imaging device shown in FIG. 1 depicting the major subsystems of the ink imaging device.

As shown in FIG. 2, the ink printer 10 may include an ink loading subsystem 40, an electronics module 72, a paper/media tray 74, a print head 52, an intermediate imaging member 58, a drum maintenance subsystem 76, a transfer subsystem 80, a wiper subassembly 82, a paper/media preheater assembly 84, a duplex print path 88, and an ink waste tray 90. In brief, solid ink sticks (not shown) are loaded into ink loader 40 through which they travel to a melt plate 32. At the melt plate 32, the ink stick is melted and the liquid ink is diverted to a reservoir in the print head 52. The ink is ejected by piezoelectric elements through apertures in chemically etched stainless plates to form an image on the intermediate imaging member 58 as the member rotates.

Figure 3:
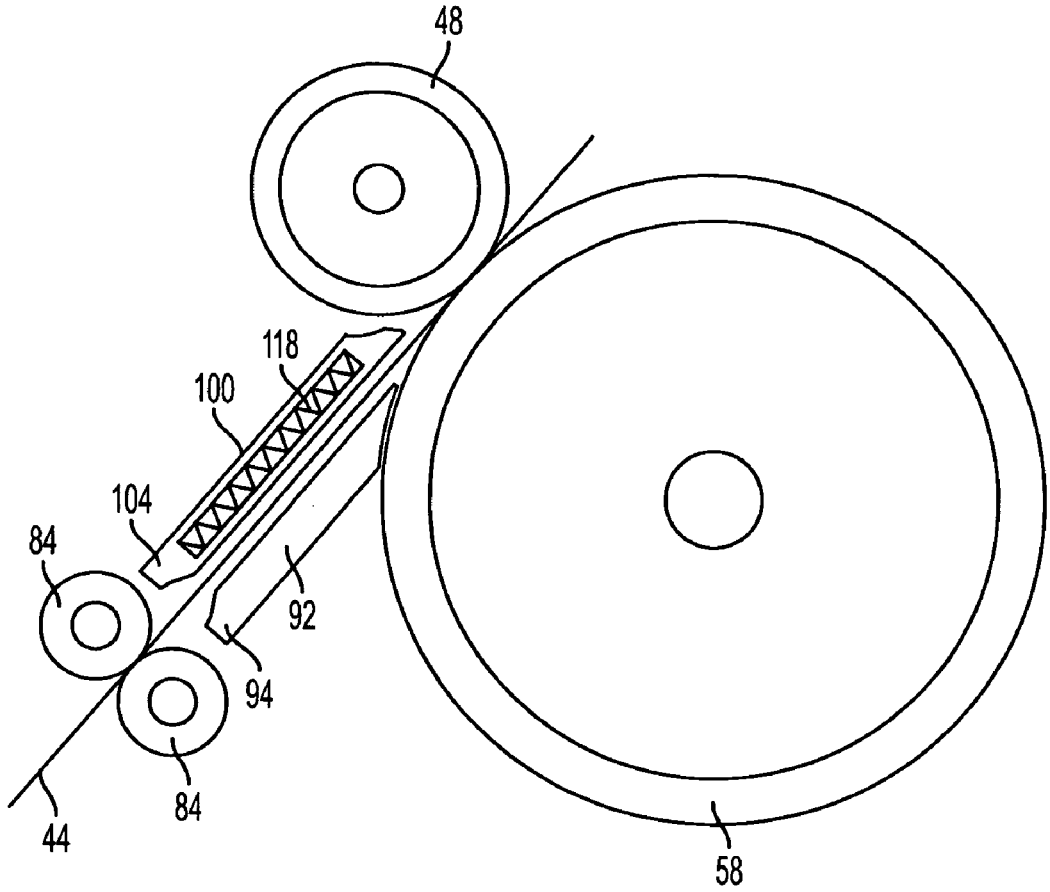
FIG. 3 is a side view showing the media preheater, print path, and imaging member of the imaging device of FIGS. 1 and 2 in greater detail.

Meanwhile, a media feed roller 42 delivers a print medium 44 to a pair of media feed rollers 84. Referring to FIGS. 2 and 3, the feed rollers 84 advance print medium 44, such as plain paper or transparency film into a nip formed between intermediate transfer member 58 and a transfer roller 48 in the transfer subsystem 80. In the embodiment of FIG. 2 and 3, the intermediate image member 58 comprises a rotating drum 58 that provides an intermediate transfer surface upon which images may be printed by the print head 52 (FIG. 2) and transferred to the sheet of printing medium 44. The media 44 passes between the drum 58 and transfer roller 48 that is biased against the drum during image transfer. Under the pressure of the transfer roller, the ink will transfer to the sheet, which is then fed out of the housing 12, while the ink solidifies as it cools.

Figure 4:
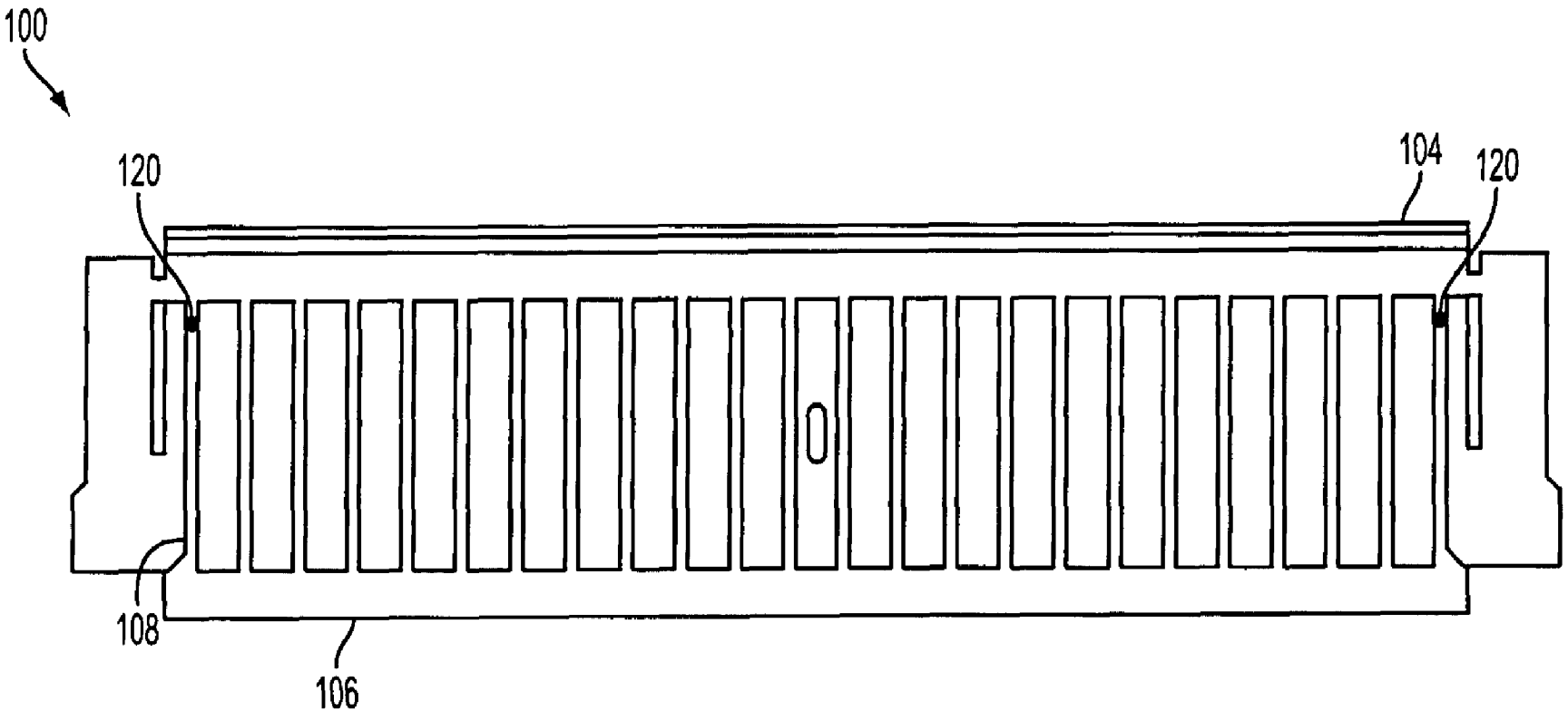
FIG. 4 is an elevational view of the media preheater of FIG. 3.

As seen in FIGS. 3 and 4, a preheater 100 may be positioned along the media pathway in order to precondition the print medium 44 by the application of thermal energy to the medium 44 prior to transfer. The preheating removes excess moisture from the medium and may result in a more dimensionally stable sheet as well as improving ink absorption into the medium. In this embodiment, the feed rollers 84 advance print medium 44 past the preheater 100 and guide plate 92 into the nip formed between intermediate transfer member 58 and a transfer roller 48. The preheater 100 and guide plate 92 are arranged to facilitate the smooth passage of the print medium 44 without excessive friction or buckling. The preheater 100 and guide plate 92 may have relatively smooth inner surfaces for allowing a relatively frictionless slide of the medium 44 across them. To provide a smooth entry, the preheater 100 and/or guide plate 92 may be flared upwardly away from the paper path at the inlet edges 104 and 94, respectively.

Figure 5:
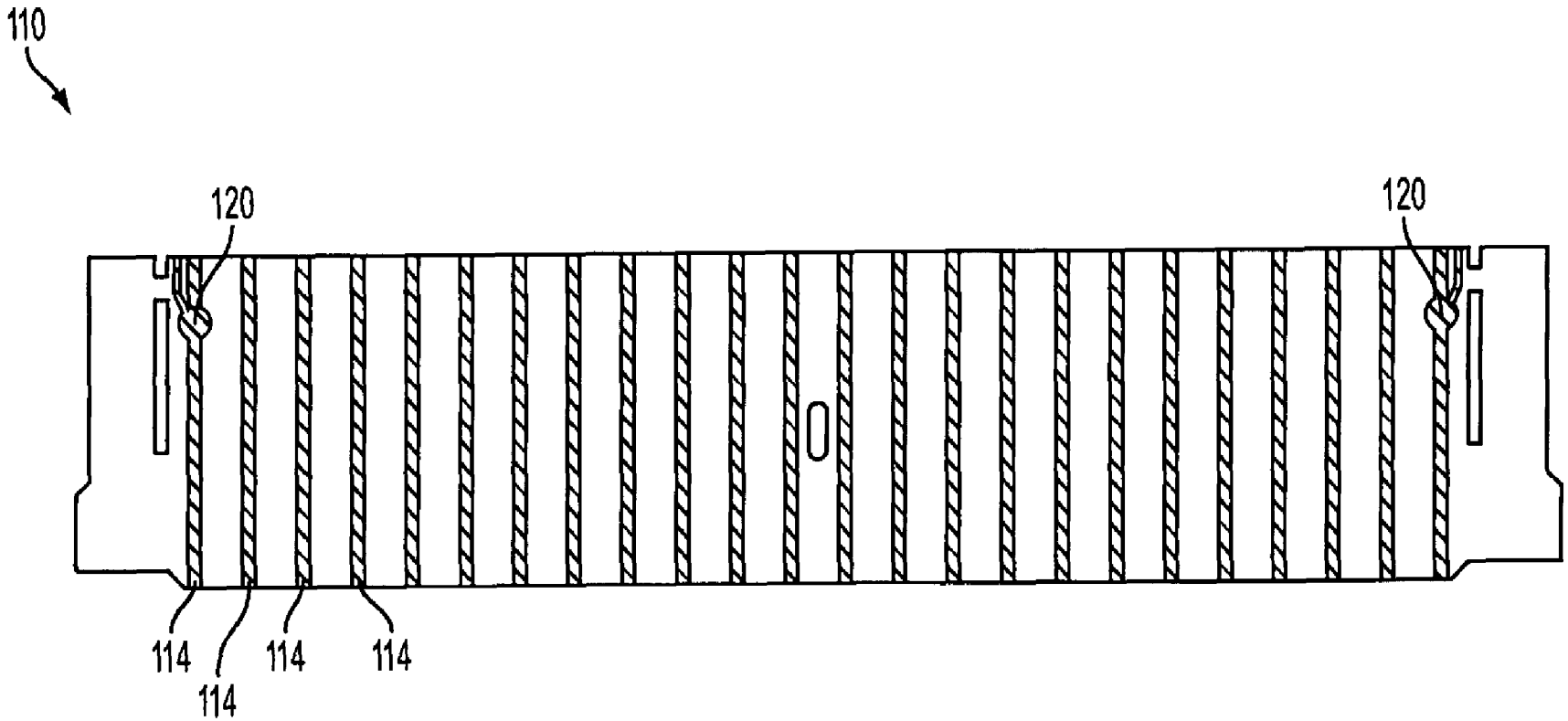
FIG. 5 is an elevational view of the carrier assembly of the media preheater of FIG. 4.

Referring now to FIG. 5, the preheater 100 may comprise an elongate planar body 108 including an inlet edge 104 and an outlet edge 106. The inlet edge 104 may be configured to be positioned oriented generally along the media pathway to receive a print medium from the feed rollers 84 as shown in FIG. 3. In one embodiment, the preheater 100 has dimensions of about 61 cm in width between the inlet and outlet edges, 256 mm in length for extending across the media pathway, and 3 mm in thickness. The substantially flat planar construction of the illustrated preheater 100 allows for more surface area to be exposed to the print media 44 as the media moves along the pathway. The dimensions and/or configuration of the preheater, however, may depend on the configuration of the imaging device and the method of feeding the recording medium in the device. For example, the media pathway may be curved, in which case, the preheater may be formed with a correspondingly curved surface.

Referring to FIG. 5, the preheater 100 is comprised of a polymeric carrier assembly 110 having a plurality of channels 114 or grooves formed therein. The development of thermal energy within the preheater 100 is accomplished through a resistance heating element disposed in the plurality of channels formed on the carrier. The channels with the resistance heating element therein may be over molded with a polymeric layer in order to substantially encapsulate the resistance heating element in the channels 114. The over molding of the channels serves to efficiently conduct heat away from the resistance element to the exterior surface of the preheater and to secure the resistance heating element in the channels.

Referring to FIG. 5, the carrier assembly 110 may be a single-piece injection molded component made from a non-electrically conductive base resin such as, for example, polyphenylene sulfide, liquid crystal polymer or nylon. The resin compounded with additives and materials to reduce cost, improve functional properties, improve mold ability and so forth, will be termed compound. In this embodiment, the carrier assembly may have dimensions of about 49 cm in width, 256 mm in length for extending across the media pathway, and 3 mm in thickness. The carrier assembly 110, however, may have any suitable shape or dimensions. The grooves 114 in the carrier assembly 110 may serve as resistance heating element guide features as well as over molding features. In the embodiment of FIG. 5, the grooves 114 are substantially evenly distributed across the length and width of the carrier 110 so that the individual turns of the resistance heating element may be evenly spaced along all or a portion of the carrier in order to provide substantially uniform heat generation. The spacing and configuration of the grooves 114, however, may be varied to provide different rates of heating along the surface of the preheater 100. Grooves or openings in the carrier are ways to control, guide, position and/or retain heater placement, alternatives may be a series of threading or looming holes and/or protruding pins or bosses or other features or combinations that enable controlled routing or placement of the heater element. The carrier assembly 110 may include features 120 for incorporating electrical contacts 120 to which the resistance heating element may be riveted, soldered, brazed, clinched, compression fitted or otherwise coupled. In addition, the carrier assembly 110 may include features for the mounting of other electrical components such as, for example, thermistors for monitoring the temperature of the preheater. The carrier may be planer or may have a 3 dimensional topography, such as a one or two dimensional arc, in either case when over molded may present a planer heated surface or one that is non planer. The device may include non heated sections, mounting tabs, as example, and may be of a geometrical shape that requires non uniform heater element placement to obtain a more uniform thermal temperature over the functional heating surface. Additionally, the thermal energy produced may preferentially be non uniform to benefit a particular application, imparting a reduced amount of heat into the media near the heater leading edge so media can be staged at the opening to the preheater without excess drying, as example.

The resistance heating element may comprise a resistance heating wire 118 (FIG. 3) that may be attached to the carrier 110 using the channels 114 as guiding features so that the wire is distributed across the length and width of the heating area. The resistance wire includes a pair of termination ends for connecting to the electrical contacts 120 of the carrier assembly. The resistance wire 118 may be an electrically resistive heating conductor composed of alloys that is configured such that heat is produced when electrical power is applied to it via first end 10 or second end 12. Current may be passed from end to end or the heater element length may be bisected by adding an intermediate connection. In this case the legs of the element on either side of the intermediate connection may be of equal or unequal length as a means of achieving desired thermal gradient or uniformity. In one embodiment, the resistance wire comprises NiCr (nickel chromium alloy) wire although the selection of materials for the resistance element is based primarily on the heater device geometry and operating temperature of the heater. The size and length of the heating wire will vary depending on the specific application, including the heat to be generated and the physical dimensions of the carrier. Heating wire would most generally have a round cross section but may be flattened, be rectangle or any other suitable shape for a given application. The resistance heating element may be disposed in the carrier channels 114 using any suitable method. For example, the resistance heating element may be wound onto the carrier using a winding fixture similar to a lathe.

Figure 6:
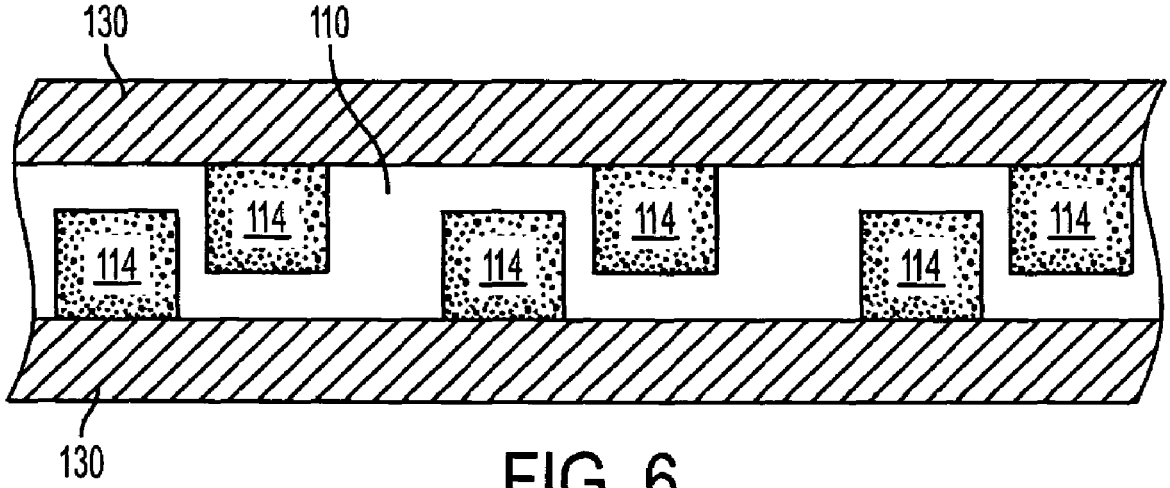
FIG. 6 is a side cross-sectional view of a portion of a molding tool for use in molding the media preheater of FIG. 3.

Once the resistance heating element is placed in proper configuration on the carrier assembly 110, the channels of the carrier assembly are encapsulated by the over mold layer. The over mold layer is comprised of a non-electrically conductive resin such as, for example, polyphenylene sulfide, liquid crystal polymer, silicone, or nylon. The material may have particulate additives or other compounding elements such as, for example, alloys containing silver, copper, aluminum, tungsten or graphite that provide a thermally conductive property. Thermally conductive material is preferred to obtain greater temperature uniformity and to reduce the time required to transfer heat from the heater element to functional surfaces. In addition to the channels, the over mold layer may be used to form the inlet and/or outlet edges of the preheater as shown in FIG. 6. The thermally conductive material compound may be the same material as that used to form the carrier assembly.

The over molded layer may be formed by injection molding. Referring to FIG. 6, in this embodiment, the assembly comprising the carrier 110 and resistance heating wire may be inserted into a molding tool 130 as an insert. The thermally conductive compound is then injected molded into the molding tool substantially filling the channels 114 of the carrier as shown in FIG. 6. The injection molding of the thermally conductive compound may more efficiently fill the spaces and voids in the channels and around the resistance heating wire, thus promoting even more efficient distribution of heat across the preheater and avoiding the occurrence of hot spots along the preheater, which could lead to uneven heating of the print media.

Figure 7:
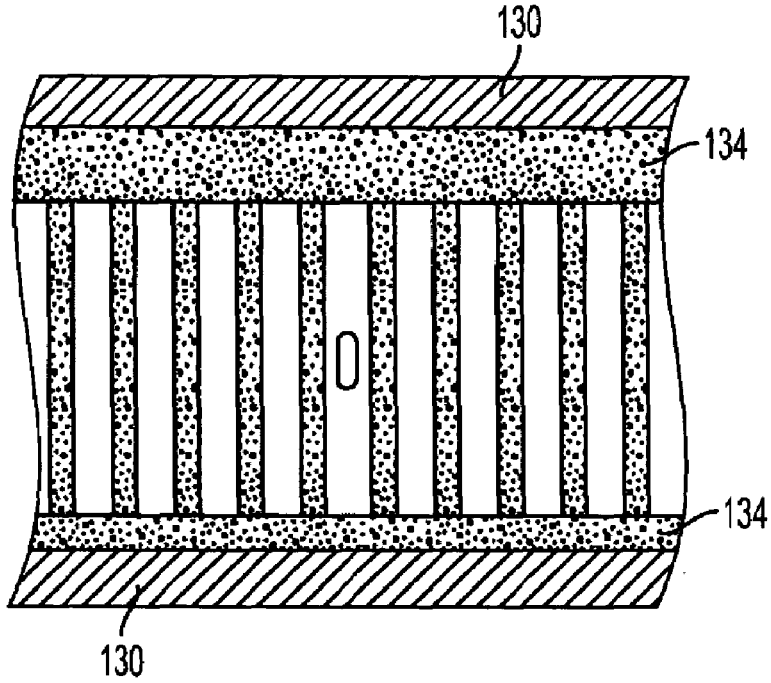
FIG. 7 is a cross-sectional plan view of the molding tool and carrier assembly of FIG. 6.

The molding tool 130 may be configured to ensure that the thermally conductive compound injection molded into the channels is substantially flush with the exterior surface of the carrier assembly 110 as shown in FIG. 6. Referring to FIG. 7, in addition, the molding tool 130 may be configured to provide spaces 134 or voids at positions in relation to the carrier assembly 110 corresponding to the inlet 104 and outlet edges 108 of the preheater 100. In this way, the inlet and outlet edges of the preheater may be formed during the injection molding process thereby simplifying the construction of the carrier assembly 110.

In operation, power to the contacts 120 of the preheater 100 may be provided via a 100 VAC signal from a power supply (not shown). A thermistor (not shown) may be used to monitor the temperature of the preheater 100 to ensure that the preheater is operating at the standard operating temperature for preheating of the medium 44 during normal operation. In one embodiment, the normal operating temperature of the preheater is approximately 60° C. The preheater, however, may be configured to operate at any suitable temperature for preheating the print medium to a predetermined temperature.

Figure 8:
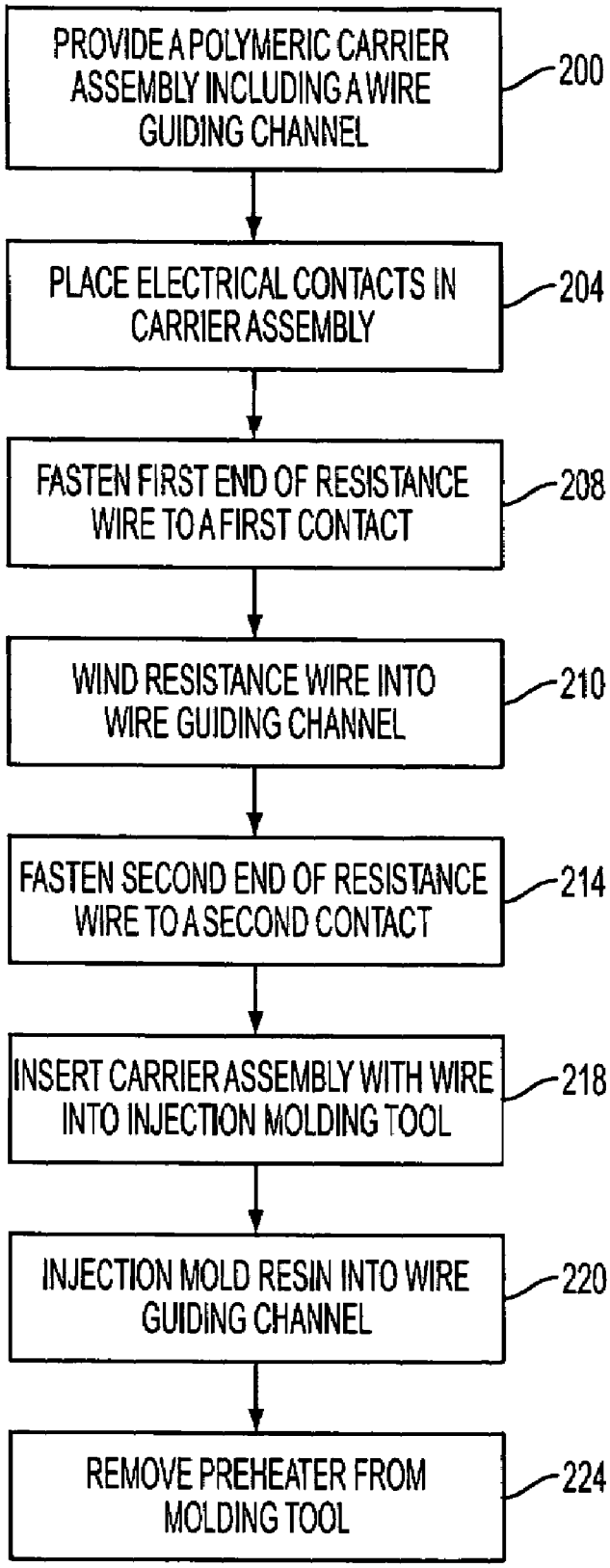
FIG. 8 depicts a flowchart of a method of manufacturing the media preheater of FIG. 3.

Referring now to FIG. 8, there is shown a flow chart of a method of manufacturing the preheater 100 described above. As mentioned above, the preheater comprises a carrier assembly including a channel, a resistance wire wound into the channel, and a thermally conductive compound over molding the channel. The method comprises, first, fabricating or otherwise providing the carrier assembly composed of a thermally conductive compound such as, for example, polyphenylene sulfide (block 200). In one embodiment, the carrier assembly may be fabricated using an injection molding process. The carrier assembly may be formed with at least a pair of contact cavities for the placement of power contacts. In addition, the carrier assembly may also be formed with a plurality of grooves or channels to serve as wire guiding features as well as over molding features. These channels may be spaced sufficiently to provide a seat for electrically separating portions of a resistance heating wire. In one embodiment, the target resistivity for the resistance wire is approximately 50 ohms. Once the carrier assembly has been fabricated, electrical contacts are provided in the contact cavities (block 204). The contacts may be provided with seal offs so that the contacts may be accessed after the overcoat layer has been applied.

A resistance heating wire is then provided for winding around the carrier assembly. In one embodiment, the resistance wire comprises a NiCr wire. A first end of the resistance wire is fastened to a first contact (block 208) provided on the carrier assembly. The wire may be fastened by crimping, although any suitable method of attachment may be used. The resistance wire is then wound around the carrier assembly using the channels as wire guides (block 210). Once the resistance wire has been wound around the carrier assembly, a second end of the wire is fastened to a second contact on the carrier assembly (block 214). The resistance of the wire may be measured to ensure that the resistance is at the target resistance which, as described above, may be 50 ohms.

A thermally conductive compound is then over molded over the channels of the carrier assembly thereby encapsulating the resistance wire therein. The thermally conductive compound may comprise polyphenylene sulfide. Thus, the same material may be used to form the carrier assembly and the overcoat layer. In one embodiment, the carrier assembly including the wound resistance wire is inserted into a molding tool so that the thermally conductive compound may be injection molded into the channels (block 218). The molding tool may include spaces or voids in positions in relation to the carrier assembly corresponding to the inlet and/or outlet edges of the carrier assembly to impart a desired configuration to the inlet and/or outlet edges of the preheater. The thermally conductive compound is then injected into the molding tool thereby filling the channels and other spaces or voids that may be provided in the molding tool (block 220). The thermally conductive compound injected into the molding tool is then allowed to cool and harden. Thereafter, the completed preheater may be removed from the molding tool (block 224).

Those skilled in the art will recognize that numerous modifications can be made to the specific implementations of the melting chamber described above. For example, the preheater of this disclosure may be used with other imaging technologies in addition to the phase change ink device described above. The preheater may be used to heat media in ink-jet or laser printers using either solid or liquid inks, as well as, electrostatographic imaging devices. Therefore, the following claims are not to be limited to the specific embodiments illustrated and described above. The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others

What is claimed is:

1. A heater for preheating media in an imaging device, the heater comprising:

a polymeric carrier having an exterior surface and a plurality of channels formed in the exterior surface of the polymeric carrier, the plurality of channels extending across the exterior surface of the polymeric carrier;

a resistance heating element disposed within the plurality of channels formed in the exterior surface of the polymeric carrier, the resistance heating element having a first end and a second end; and an over molded polymeric layer that fills the plurality of channels formed in the exterior surface of the polymeric carrier and is flush with the exterior surface of the polymeric carrier to encapsulate the resistance heating element, the over molded polymeric layer being formed of a thermally conductive, non-electrically conductive compound to enable the heater to have temperature uniformity and to facilitate heat transfer from the encapsulated resistance heating element to media proximate the exterior surface of the polymeric carrier.

2. The heater of claim 1 further comprising:

a pair of electrical contacts mounted to the polymeric carrier, the electrical contacts being configured to electrically connect to the first and second ends of the resistance heating element to enable the resistance heating element to be electrically connected to electrical power.

3. The heater of claim 1, the polymeric carrier including a top and bottom surface, the resistance heating element and the plurality of channels being configured in a winding pattern across the exterior surface of the polymeric carrier.

4. The heater of claim 1, the polymeric carrier also being formed of a thermally conductive, non-electrically conductive compound.

5. The heater of claim 4, the polymeric carrier and the over molded layer being essentially comprised of a material from the group comprised of polyphenylene sulphide (PPS), liquid crystal polymer (LCP), and nylon in which a thermally conductive material has been distributed to provide thermal conductivity in the polymeric carrier and the over molded polymer layer.

6. The heater of claim 1, the resistance heating element comprising a resistance heating wire.

7. The heater of claim 6, the resistance heating wire being formed from an alloy essentially comprised of nickel and chromium.

8. A method of manufacturing a heater for use in an imaging device, the method comprising:

guiding a resistance heating wire through a plurality of channels formed in and across an exterior surface of a polymeric carrier; and over molding a polymer layer over the resistance heating wire to fill the plurality of channels formed in the polymeric carrier and be flush with the exterior surface of the polymeric carrier to enable the over molded polymer layer to encapsulate the resistance heating wire, the over molded polymeric layer being formed of a thermally conductive, non-electrically conductive compound to enable the heater to have temperature uniformity and to facilitate heat transfer from the encapsulated resistance heating wire to media proximate the heater.

9. The method of claim 8, the guiding of the resistance heating wire further comprising:

guiding the resistance heating wire through the plurality of channels formed in a top exterior surface and a bottom exterior surface of the polymeric carrier.

10. The method of claim 8, the over molding of the polymer layer over the plurality of channels further comprising:

inserting the polymeric carrier with the resistance heating wire guided through the plurality of channels into a molding tool; and injection molding a polymer into the molding tool to form the over molded polymer layer that fills the plurality of channels and is flush with the exterior surface of the polymeric carrier to encapsulate the resistance heating wire.

11. The method of claim 8, further comprising:

forming the polymeric carrier with a thermally conductive, non-electrically conductive compound prior to the guiding of the resistance heating wire.

12. The method of claim 11 wherein the polymeric carrier is essentially comprised of a thermally conductive, non-electrically conductive resin.

13. The method of claim 12 wherein the thermally conductive, non-electrically conductive resin is essentially comprised of a material from the group comprising polyphenylene sulfide (PPS), liquid crystal polymer (LCP), and nylon in which a thermally conductive material has been distributed to provide thermally conductivity in the polymeric carrier.

14. The method of claim 8 wherein the resistance heating wire is formed of an alloy essentially comprised of nickel and chromium.

15. A heater for preheating media in an imaging device, the heater comprising:

a polymeric carrier, the polymeric carrier including an exterior surface in which a plurality of channels are formed, a leading edge, and a trailing edge;

a pair of electrical contacts formed in the exterior surface of the polymeric carrier, the electrical contacts being configured to electrically connect to an electrical power source;

a plurality of resistance heating wire placement features on the exterior surface of the polymeric carrier, the resistance heating wire placement features defining a circuitous path across a length and a width of the polymeric carrier;

a resistance heating wire disposed in the plurality of channels and the resistance heating wire placement features, the resistance heating wire having a first end electrically connected to one of the electrical contacts and a second end electrically connected to the other electrical contact in the pair of electrical contacts; and an over molded polymeric layer that fills the plurality of channels in the exterior surface of the polymeric carrier and is flush with the exterior surface of the polymeric carrier to encapsulate the resistance heating wire, the over molded polymeric layer being formed of a thermally conductive, non-electrically conductive compound to enable the heater to have temperature uniformity and to facilitate transfer heat from the encapsulated resistance heating wire to media proximate the heater.

16. The heater of claim 15, the polymeric carrier being essentially comprised of a thermally conductive, non-electrically conductive compound.

17. The heater of claim 16, the thermally conductive, non-electrically conductive compound being essentially comprised of a material from the group comprising polyphenylene sulphide (PPS), liquid crystal polymer (LCP), and nylon in which a thermally conductive material has been distributed to provide thermal conductivity in the polymeric carrier.

18. The heater of claim 15, the resistance heating wire being comprised of an alloy essentially comprised of nickel and chromium.

* * * * *